US008535113B2

(12) United States Patent
Weidert

(10) Patent No.: US 8,535,113 B2
(45) Date of Patent: Sep. 17, 2013

(54) METHODS TO CONTROL A PROCESS

(75) Inventor: Chad Michael Weidert, Gramercy, LA (US)

(73) Assignee: Shell Oil Company, Houston, TX (US)

( * ) Notice: Subject to any disclaimer, the term of this patent is extended or adjusted under 35 U.S.C. 154(b) by 778 days.

(21) Appl. No.: 12/602,856

(22) PCT Filed: Jun. 9, 2008

(86) PCT No.: PCT/US2008/066235

§ 371 (c)(1),
(2), (4) Date: Dec. 3, 2009

(87) PCT Pub. No.: WO2008/154462

PCT Pub. Date: Dec. 18, 2008

(65) Prior Publication Data

US 2010/0175758 A1 Jul. 15, 2010

Related U.S. Application Data

(60) Provisional application No. 60/942,528, filed on Jun. 7, 2007.

(51) Int. Cl.
*B24B 49/00* (2012.01)
*B24B 51/00* (2006.01)

(52) U.S. Cl.
USPC ..... 451/2; 451/8; 451/39; 451/40

(58) Field of Classification Search
USPC ..... 134/115 R; 137/2; 451/2, 8, 36, 451/38, 39, 40, 99
See application file for complete search history.

(56) References Cited

U.S. PATENT DOCUMENTS

| | | | | |
|---|---|---|---|---|
| 5,024,029 | A * | 6/1991 | Abbott et al. | 451/101 |
| 5,176,018 | A * | 1/1993 | Thompson | 72/53 |
| 6,405,738 | B1 | 6/2002 | Clark et al. | 134/115 R |
| 6,694,789 | B2 * | 2/2004 | Yamamoto et al. | 72/53 |
| 6,722,584 | B2 * | 4/2004 | Kay et al. | 451/439 |
| 6,752,688 | B2 * | 6/2004 | Adachi et al. | 451/5 |
| 6,887,125 | B2 * | 5/2005 | Kurogouchi | 451/5 |
| 7,028,697 | B2 | 4/2006 | Christman et al. | 134/115 |
| 7,310,955 | B2 * | 12/2007 | Hume et al. | 62/52.1 |
| 2005/0191183 | A1 | 9/2005 | Kawakami et al. | |
| 2005/0229845 | A1 | 10/2005 | Mather et al. | 118/308 |

* cited by examiner

*Primary Examiner* — Timothy V Eley

(57) ABSTRACT

A system comprising a system comprising a valve; a controller adapted to actuate the valve; a pressurized source connected to the valve; a hose and nozzle assembly connected to the pressurized source through the valve; and a switch connected to the nozzle assembly; wherein a flow from the pressurized source to the nozzle may be interrupted by the valve and by the nozzle.

9 Claims, 2 Drawing Sheets

METHODS TO CONTROL A PROCESS

PRIORITY CLAIM

The present application claims priority of U.S. Provisional Patent Application No. 60/942,528 filed 7 Jun. 2007.

FIELD OF INVENTION

The present disclosure relates to systems and methods for controlling a manual process.

BACKGROUND

Various types of manual processes can be carried out with a worker with a hose and switch, the hose connected to a pressurized medium. Examples include pressure washing, abrasive blasting, spray painting, and others as are known in the art.

In this type of operation, the worker activates the switch in order to start the flow of the pressurized medium through the hose in order to achieve a desired result, for example paint or clean a work piece.

A dangerous situation could develop in the event that the switch became stuck in the open position, or if the worker locked the switch in the open position. In such a case, the pressurized medium would continue flowing through the hose continuously.

U.S. Pat. No. 6,405,738 discloses a fryer system having a vat having four sides and a bottom. A plurality of heat exchange tubes extends across the vat. A spray unit having at least one nozzle disposed above the plurality of heat exchange tubes is operably connected to a fluid supply. The spray unit is oriented to direct a flow of fluid onto the sides and bottom of the vat and onto the heat exchange tubes. U.S. Pat. No. 6,405,738 is herein incorporated by reference in its entirety.

There is a need in the art for systems and/or methods to control pressurized systems.

There is a need in the art for systems and/or methods to shut off pressurized systems.

There is a need in the art for systems and/or methods to limit operator error in the use of pressurized systems.

SUMMARY OF THE INVENTION

One aspect of the invention includes a system comprising a valve; a controller adapted to actuate the valve; a pressurized source connected to the valve; a hose and nozzle assembly connected to the pressurized source through the valve; and a switch connected to the nozzle assembly; wherein a flow from the pressurized source to the nozzle may be interrupted by the valve and by the nozzle.

Another aspect of the invention includes a method comprising connecting a pressurized source to a nozzle through a valve; connecting a controller to the valve; activating a switch to start a flow from the pressurized source to the nozzle; and keeping the valve closed until the controller verifies that all required parameters are within set values.

Advantages of the invention include one or more of the following:

Systems and/or methods to control pressurized systems;

systems and/or methods to shut off pressurized systems; and/or systems and/or methods to limit operator error in the use of pressurized systems.

DETAILED DESCRIPTION OF THE INVENTION

FIG. 1

Figure 1:
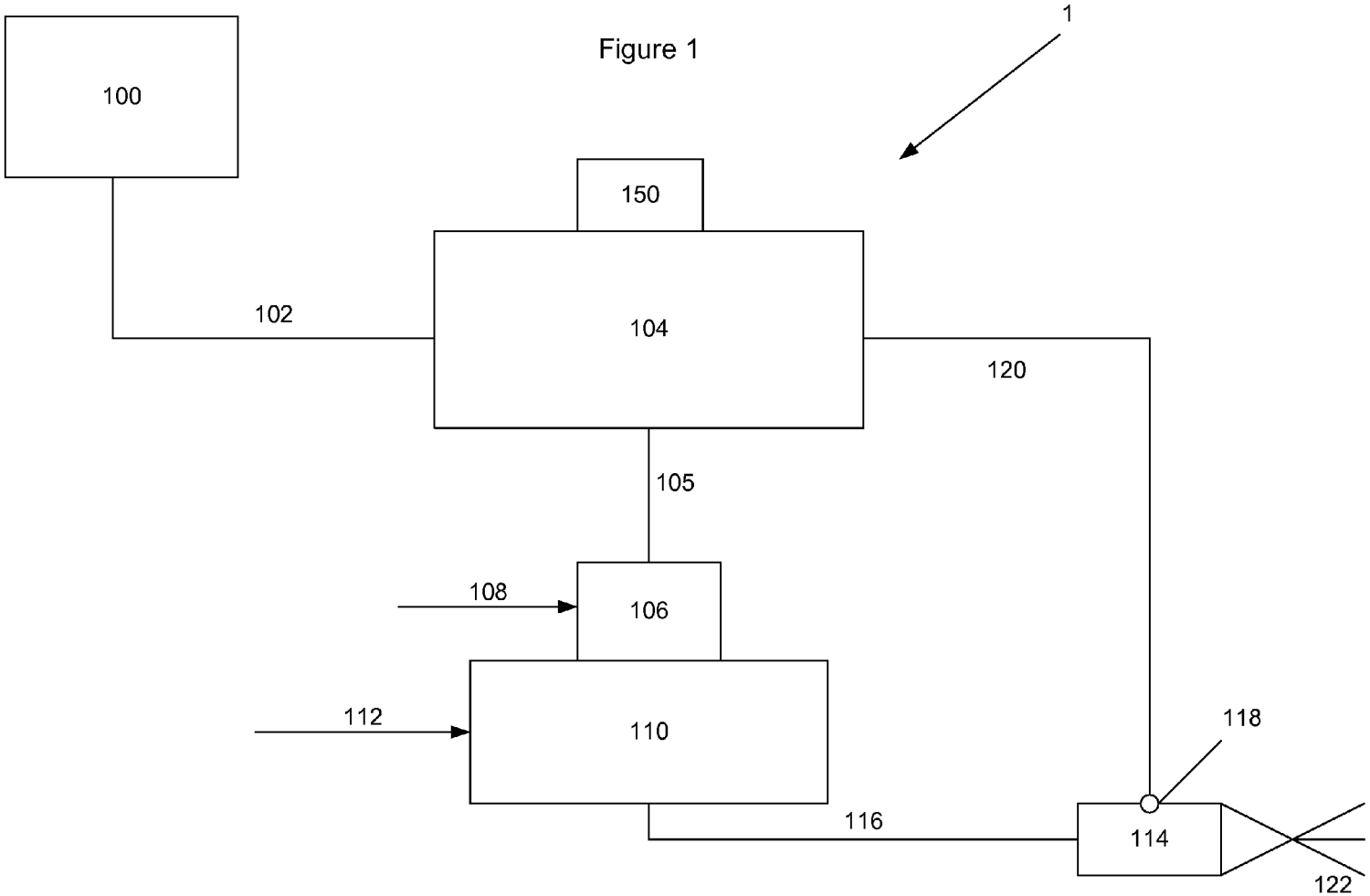
FIG. 1 illustrates a system for controlling a pressurized spray nozzle.

Referring now to FIG. 1, system 1 is illustrated. System 1 includes power supply 100. Power supply 100 is connected to controller 104 by conduit 102. Controller is connected to solenoid 106, which is fed by instrument air supply 108. Solenoid 106 may be used to actuate valve 110, which is connected to pressurized medium 112. Pressurized medium 112 flows across valve 110 to spray nozzle 114 by hose 116. Nozzle 114 includes activation switch 118. Switch 118 is connected back to controller 104 by conduit 120. Controller 104 may also include emergency shut off 150.

In operation, all of the components are connected as above. Operator (not shown) activates switch 118 to start the flow of pressurized medium. Signal from switch 118 is transmitted to controller 104 by conduit 120. Controller verifies that all the parameters are within limits, then starts the flow of pressurized medium. The pressurized medium 122 flows through nozzle 114, until operator releases the switch 118 or until one of the limits of one of the parameters is exceeded, and controller 104 activates solenoid 106 to shut valve 110.

In one example, pressurized medium may be sand and air used to clean a surface. The parameters may be a time limit on the amount of blasting per switch activation, minimum and maximum air pressures, sufficient sand in the hopper, minimum and maximum operating temperatures, and other parameters that may be input into the controller 104.

In another example, a prior art system was used that the operator locked the switch in an open position and the abrasive blasting cut a hole through a pressure vessel after 20 minutes of operation. With system 1, this could have been avoided, by limiting the open valve time to 1 minute. After the operator locked switch 118 in an open position, abrasive medium would have flowed for 1 minute, then valve 110 would have closed, and system 1 would have reset for the next cycle.

FIG. 2

Figure 2:
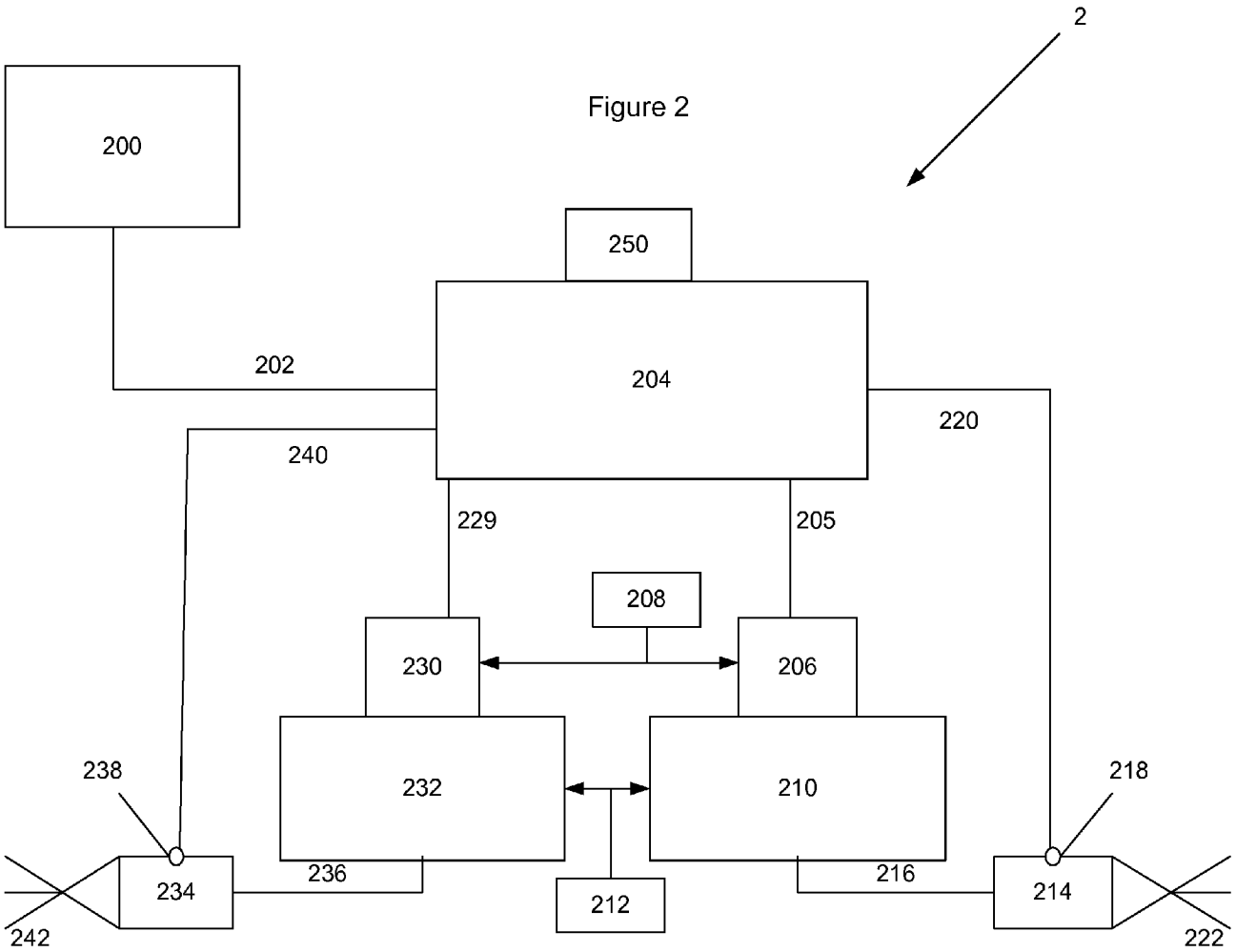
FIG. 2 illustrates a system for controlling multiple pressurized spray nozzles.

Referring now to FIG. 2, system 2 is illustrated. System 2 includes power supply 200. Power supply 200 is connected to controller 204 by conduit 202. Controller 204 is connected to solenoid 206 by conduit 205, which solenoid 206 is fed by instrument air supply 208. Solenoid 206 may be used to actuate valve 210, which is connected to pressurized medium 212. Pressurized medium 212 flows across valve 210 to spray nozzle 214 by hose 216. Nozzle 214 includes activation switch 218. Switch 218 is connected back to controller 204 by conduit 220. Controller 204 may also include emergency shut off 250.

Controller 204 is also connected to solenoid 230 by conduit 229, which solenoid 230 is fed by instrument air supply 208. Solenoid 230 may be used to actuate valve 232, which is connected to pressurized medium 212. Pressurized medium 212 flows across valve 232 to spray nozzle 234 by hose 236. Nozzle 234 includes activation switch 238. Switch 238 is connected back to controller 204 by conduit 240.

In operation, all of the components are connected as above. First operator (not shown) activates switch 218 to start the flow of pressurized medium. Signal from switch 218 is transmitted to controller 204 by conduit 220. Controller verifies that all the parameters are within limits, then starts the flow of pressurized medium. The pressurized medium 222 flows through nozzle 214, until operator releases the switch 218 or until one of the limits of one of the parameters is exceeded, and controller 204 activates solenoid 206 to shut valve 210.

At the same time, second operator (not shown) activates switch 238 to start the flow of pressurized medium. Signal from switch 238 is transmitted to controller 204 by conduit 240. Controller verifies that all the parameters are within limits, then starts the flow of pressurized medium. The pressurized medium 242 flows through nozzle 234, until operator releases the switch 238 or until one of the limits of one of the parameters is exceeded, and controller 204 activates solenoid 230 to shut valve 232.

ILLUSTRATIVE EMBODIMENTS

In one embodiment, there is disclosed a system comprising a valve; a controller adapted to actuate the valve; a pressurized source connected to the valve; a hose and nozzle assembly connected to the pressurized source through the valve; and a switch connected to the nozzle assembly; wherein a flow from the pressurized source to the nozzle may be interrupted by the valve and by the nozzle. In some embodiments, the controller further comprises a timer. In some embodiments, the switch is connected to the controller. In some embodiments, one or more additional hose and nozzle assemblies are connected to the pressurized source through a valve, for example from about 2 to about 10, or from about 3 to about 5. In some embodiments, the controller further comprises a timer which closes the valve from 10 to 90 seconds after the switch on the nozzle is activated. In some embodiments, the system also includes a solenoid, the solenoid adapted to close the valve after receiving a signal from the controller. In some embodiments, the pressurized source comprises compressed air and an abrasive medium. In some embodiments, the pressurized source comprises compressed air and an abrasive medium comprising sand. In some embodiments, the pressurized source comprises paint. In some embodiments, the pressurized source comprises compressed water.

In one embodiment, there is disclosed a method comprising connecting a pressurized source to a nozzle through a valve; connecting a controller to the valve; activating a switch to start a flow from the pressurized source to the nozzle; and keeping the valve closed until the controller verifies that all required parameters are within set values. In some embodiments, one parameter is maximum flow time. In some embodiments, the method also includes stopping the flow when the maximum flow time has been reached. In some embodiments, the method also includes stopping the flow by deactivating the switch. In some embodiments, the pressurized source comprises compressed air. In some embodiments, the pressurized source comprises compressed water. In some embodiments, the pressurized source comprises an abrasive medium, selected from sand, grit, rocks, aluminum oxide, silicon carbide, metal shot, coal slags, and glass beads. In some embodiments, the method also includes stopping the flow by activating an emergency shutoff on the controller.

Those of skill in the art will appreciate that many modifications and variations are possible in terms of the disclosed embodiments, configurations, materials and methods without departing from their spirit and scope. Accordingly, the scope of the claims appended hereafter and their functional equivalents should not be limited by particular embodiments described and illustrated herein, as these are merely exemplary in nature.

That which is claimed is:

1. A method comprising:

connecting a pressurized source to a nozzle through a valve;

connecting a controller to the valve, wherein the controller receives a value of a parameter related to operation of the nozzle;

activating a switch to permit a pressurized medium to flow from the pressurized source toward the nozzle;

keeping the valve closed until the controller verifies that the value of the parameter is within a set limit;

verifying, with the controller, that the value is within the set limit; and, responsive to verification that the value is within the set limit, opening the valve, permitting the pressurized medium to flow from the pressurized source through the valve to the nozzle.

2. The method of claim 1, wherein the parameter comprises maximum flow time.

3. The method of claim 2, further comprising stopping the flow when the maximum flow time has been reached.

4. The method of claim 1, further comprising stopping the flow by deactivating the switch.

5. The method of claim 1, wherein the pressurized source comprises compressed air.

6. The method of claim 1, wherein the pressurized source comprises compressed water.

7. The method of claim 1, wherein the pressurized source comprises an abrasive medium, selected from sand, grit, rocks, aluminum oxide, silicon carbide, metal shot, coal slags, and glass beads.

8. The method of claim 1, further comprising stopping the flow by activating an emergency shutoff on the controller.

9. The method of claim 1:

wherein the controller receives values of multiple parameters related to operation of the nozzle;

wherein keeping the valve closed comprises keeping the valve closed until the controller verifies that each of the values is within a set limit for the corresponding parameter;

wherein verifying comprises verifying that each of the values is within the corresponding set limit; and wherein opening the valve is responsive to verification that each of the values is within the corresponding set limit.

* * * * *